US007764157B2

(12) United States Patent
Schulz et al.

(10) Patent No.: US 7,764,157 B2
(45) Date of Patent: Jul. 27, 2010

(54) TRANSFORMER

(75) Inventors: Reinhold Schulz, Harsewinkel (DE); Hans-Jürgen Mans, Greven (DE); Michael Becks, Telgte (DE); Andreas Kniesel, Münster (DE); Peter Grad, Münster (DE); Wolfgang Lödde, Münster (DE); Olaf Blömker, Warendorf (DE)

(73) Assignee: Power Systems Technologies, GmbH, Ostbevern (DE)

( * ) Notice: Subject to any disclaimer, the term of this patent is extended or adjusted under 35 U.S.C. 154(b) by 840 days.

(21) Appl. No.: 10/555,153

(22) PCT Filed: May 6, 2003

(86) PCT No.: PCT/EP03/04760

§ 371 (c)(1),
(2), (4) Date: Feb. 6, 2007

(87) PCT Pub. No.: WO2004/100192

PCT Pub. Date: Nov. 18, 2004

(65) Prior Publication Data

US 2007/0126545 A1 Jun. 7, 2007

(51) Int. Cl.
*H01F 27/30* (2006.01)

(52) U.S. Cl. ..... 336/198

(58) Field of Classification Search ..... 336/65, 336/107, 192, 198, 200, 232
See application file for complete search history.

(56) References Cited

U.S. PATENT DOCUMENTS 3,663,914 A * 5/1972 Lane ..... 336/192
3,711,806 A * 1/1973 Flentge ..... 336/92
4,205,291 A * 5/1980 Flentge ..... 336/92
4,324,865 A * 4/1982 Reale ..... 521/107
4,954,940 A 9/1990 Chandler et al.
5,200,731 A * 4/1993 Tochio et al. ..... 336/98
6,344,786 B1 * 2/2002 Chin ..... 336/198

FOREIGN PATENT DOCUMENTS

EP 0 364 811 4/1990
GB 1 240 795 7/1971
GB 1 250 827 10/1971

OTHER PUBLICATIONS

Lodestone Pacific bobbin specifcation.*

* cited by examiner

*Primary Examiner*—Tuyen Nguyen
(74) *Attorney, Agent, or Firm*—Robert G. Crouch; Marsh, Fischmann Breyfogle, LLP

(57) ABSTRACT

The present invention relates to a transformer with a coil body accommodating at least one primary coil and one secondary coil. It is the object of the present invention to provide a transformer which, using the smallest possible amount of high-grade insulation material, ensures good insulation while remaining compact and easily assembled. The object is achieved by a transformer of the above type which is characterized in that the coil body comprises at least one primary part, accommodating the primary coil, and one secondary part, accommodating the secondary coil, and wherein at least one section of the primary part can be covered by at least one section of the secondary part. This section of the secondary part performs the function of the fire-protection housing for the primary part of the transformer.

10 Claims, 6 Drawing Sheets

TRANSFORMER

The present invention relates to a transformer with a coil body accommodating at least one primary coil and one secondary coil.

Transformers of the above type are used e.g. to supply a low voltage to high-volume consumer products. To comply with whatever safety standards are in force, such transformers are enclosed in a housing made of a plastic material of the fire-protection class UL94-V1 or better. Such insulation materials are, however, relatively expensive. Many manufacturers therefore seek to minimize the use of these high-grade materials.

An example of this is referred to in the European patent application No. 01 309 737.3. Here the insulation of a transformer is provided by a second covering made of fire-protection material, in addition to a main housing made of simple material. The second covering encloses part of a primary coil of the transformer and connection pins which extend from the primary coil. This arrangement is relatively complicated, particularly as regards the assembly of the transformer. Furthermore, the size and the weight of the power supply unit increase due to the additional second covering.

It is the object of the present invention to provide a transformer which, using the smallest possible amount of high-grade insulation material, ensures good insulation while remaining compact and easily assembled.

This object is achieved by a transformer of the above type which is characterized in that the coil body comprises at least one primary part, accommodating the primary coil, and one secondary part, accommodating the secondary coil, and wherein at least one section of the primary part can be covered by at least one section of the secondary part.

This transformer has the advantage that the secondary part has a double function. Firstly, it carries the secondary coil. Secondly, at least one section of the secondary part serves to cover at least one section of the primary part, thus enabling the secondary part to provide insulation and the function of fire-protection for said at least one section of the primary part. As a result of the transfer of both these functions to the secondary part of the transformer, there is either no need for additional coverings or their number can be reduced. The transformer can thus be made compact and light and its assembly can be simplified.

According to an advantageous embodiment of the invention at least a region of the primary coil can be covered by the secondary part. Insulation of said at least one region of the primary coil can thus be achieved.

In a preferred example of the invention at least a contact pin region of the primary part can be covered by the secondary part. This construction has the advantage that at least a part of the contact pin region can be insulated.

According to a favourable variation of the invention the primary part and the secondary part are designed as two parts which can be separated from each another. This enables the secondary part to be moved relative to the primary part, so that said at least one section of the secondary part can easily be superimposed on said at least one section of the primary part so as to cover it.

Advantageously, said at least one section of the secondary part has an internal diameter which is greater than the external diameter of said at least one coverable section of the primary part. Consequently, said at least one section of the secondary part can be superimposed on or pushed onto said at least one coverable section of the primary part, thus ensuring that this section of the primary part is well covered.

In a further preferred embodiment of the invention the secondary part consists of a fire-protection material. With this construction the secondary part can perform a fire-protection function.

According to a further advantageous embodiment of the invention the fire-protection material is a plastic material of the fire-protection class UL94-V1 or better. This material ensures particularly good fire-protection which complies with the required safety standards in a number of countries.

The primary part is preferably connected to at least one contact pin which is covered at at least one connection region to the primary part. With this arrangement, said at least one contact pin in the connection region to the primary part can be insulated and also fixed in position.

In a further favourable embodiment of the invention the primary part is connected to at least one contact pin by means of a one-way plug connection. The one-way plug connection ensures that once a contact pin has been connected to the primary part it is held firmly in place. In this way the contact pin can be fixed in position and isolated from the user, even if the outer housing of the equipment is damaged.

In a further example of the invention the one-way plug connection has at least one locking element which engages the primary part in a connection region from behind. Such a construction ensures simple assembly of the contact pin with the primary part and a high degree of stability of the connection between the contact pin and the primary part.

The said at least one contact pin preferably has an insulated sleeve region. This provides additional user protection against contact with voltage-carrying and thus dangerous contact pins, especially in the event of damage to the outer housing of the equipment.

The present invention is described below in terms of advantageous embodiments and making reference to the relevant figures of the drawing, where FIG. 1 shows a perspective view of a primary part and of a secondary part of a transformer according to a first embodiment of the present invention;

Figure 1:
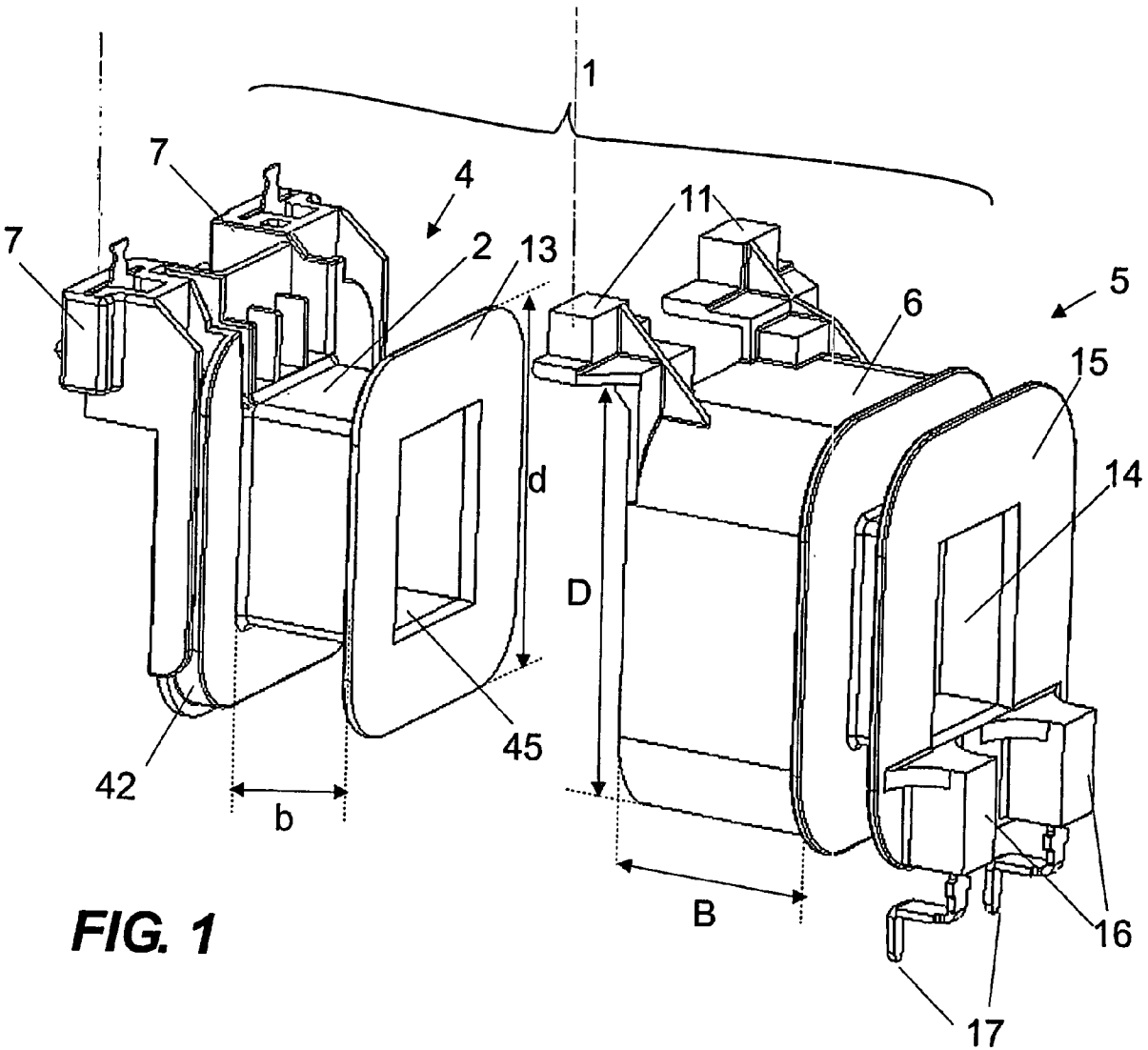

FIG. 1 shows a perspective view of a primary part 4 and of a secondary part 5 of a transformer according to a first embodiment of the present invention. In the first embodiment the primary part 4 and the secondary part 5 are, as is shown in FIG. 1, designed to be separable parts and together they form a coil body 1.

In cross-section the primary part 4 has approximately the shape of an "H". The left-hand section of the "H" in FIG. 1 constitutes a connection section 42 of the primary part 4, the upper part of which has a connection region 7 for AC contact pin contacting. The middle region of the "H" comprises an approximately rectangular spool with rounded edges. The spool serves to accommodate a primary coil 2 which is wound thereon. The right-hand section of the "H" in FIG. 1 constitutes a spool boundary 13 for the spool of the primary part 4 on this side. It has a larger diameter d than the spool with the primary coil 2 wound on it.

The primary part 4 is hollow inside. In the example shown the inner opening 45 of the primary part 4 has a roughly rectangular cross-section. The inner opening 45 later serves to house an iron core (not shown in FIG. 1).

The secondary part 5, like the primary part 4, is approximately in the form of an "H" which is hollow inside. The left-hand section of the "H" in FIG. 1 has an internal diameter D which is larger than the external diameter d of the spool boundary 13 of the primary part 4. Its breadth B is approximately the same as the breadth b of the spool and spool boundary of the primary part 4. The left-hand section of the secondary part 5 in FIG. 1 later forms a cover region 6 for the primary coil 2 of the primary part 4.

In a region of the secondary part 5 shown top left in FIG. 1, the cover region 6 has insulation parts 11 for AC contact pins (not shown in FIG. 1). The insulation parts 11 extend at an angle of roughly 90° to the direction of diametral extension D of the secondary part 5. In the embodiment shown the insulation parts 11 have an internal cross-section of roughly rectangular shape and they are hollow on the inside to provide covering for the AC contact pins or for the connection region to the contact pins. In other embodiments of the invention (not shown) the insulation parts 11 may be circular, elliptical or polygonal in cross-section, preferably adapted to the form of the contact pins to be insulated.

The "H" of the secondary part 5 has a middle region which serves as a spool on which a secondary coil 3 is wound. Like the spool of the primary part 4, the spool of the secondary part 5 is roughly rectangular in cross-section and has rounded edges. It has an inner opening 14 to accommodate an iron core (not shown in FIG. 1).

The right-hand section of the "H" of the secondary part 5 in FIG. 1 constitutes a spool boundary 15 for the secondary coil 3. The spool boundary 15 has a larger diameter than the diameter of the spool with the secondary coil 3 of the secondary part 5.

In a region of the spool boundary 15 shown at the bottom right in FIG. 1 there are connection regions 16 to provide a connection to DC contact pins 17.

The base material of the coil body 1, the cover region 6 and the insulation parts 11 of the secondary part 5 are all composed of a fire-protection material of the fire-protection class UL94-V1 or better. The windings of the primary coil 2 and of the secondary coil 3 are made of a metallic material, e.g. copper. The contact pins are also made of a metallic material, e.g. bronze.

Figure 2:
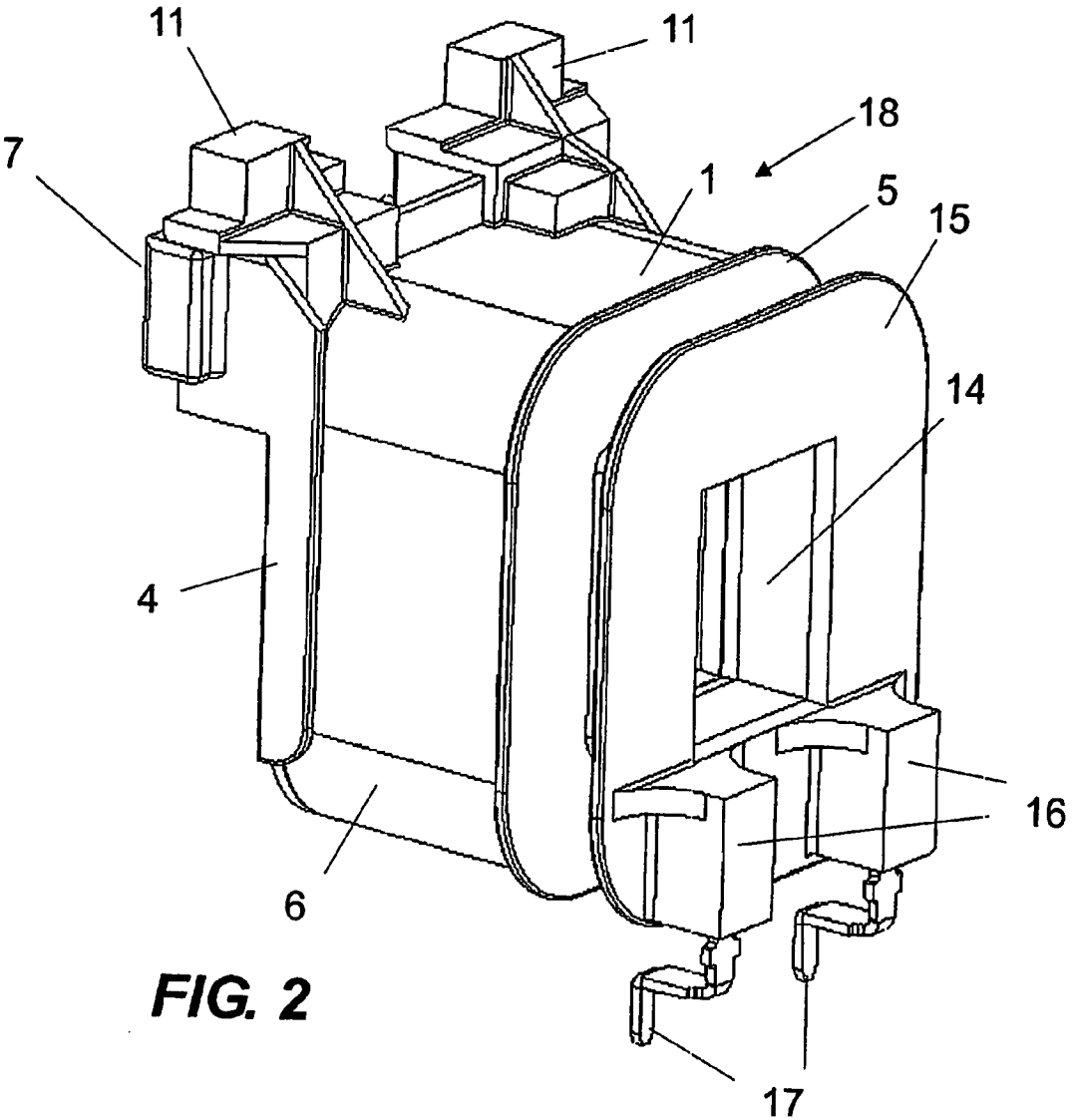
FIG. 2 shows a perspective view of an assembled transformer module according to the first embodiment of the present invention.

FIG. 2 shows a perspective view of an assembled transformer module 18 according to the first embodiment of the present invention. The transformer module shown there is formed by assembling the primary part 4 and the secondary part 5, depicted separately in FIG. 1. In the composite structure the cover region 6 of the secondary part 5 covers the primary coil 2 of the primary part 4. Also the insulation parts 11 of the secondary part 5 cover the corresponding connection regions 7 of the primary part 4.

The internal diameter D of the covering 6 of the secondary part 5 being greater than the external diameter d of the primary part, assembly of the primary and secondary parts was achieved by pushing the secondary part 5 onto the primary part 4. In the resulting composite the covering 6 of breadth B encloses the breadth b of the primary coil 2 and the spool boundary, providing both good electrical insulation for the primary coil 2 as well as good fire-protection in accordance with the fire-protection material employed.

In the embodiment shown also the insulation parts 11 were pushed onto the connection regions 7 during assembly so that they enclose them apart from the contact region. The insulation parts 11 serve both to electrically insulate the connection regions 7 and to provide fire-protection for the connection regions 7 in accordance with the fire-protection material employed.

As shown in FIG. 2, the assembled transformer module 18 is compact. Since dangerous current-carrying regions such as the primary coil 2 and the connection regions 7 are shielded by the covering 6 and the insulation parts 11, the transformer module in the form shown in FIG. 2 can be used without an additional fire-protection housing and complies with the fire-protection requirements in a number of countries despite its simple construction.

In the embodiment shown the coil body 1, composed of two halves, performs a double function. Firstly, it accommodates the wire windings of the primary coil 2 and of the secondary coil 3. Secondly, the coil body 1 fulfils the fire-protection housing function required by the regulations, whereby the use of additional plastic coverings or housing components can be eliminated or reduced. Due to the minimization of the material employed, the manufactured transformer weighs little. From FIG. 1, which shows the parts of a transformer module in the unassembled state, and from FIG. 2, which shows the transformer module after assembly, it can be seen that the transformer can be assembled simply by pushing the secondary part 5 onto the primary part 4.

Figure 3:
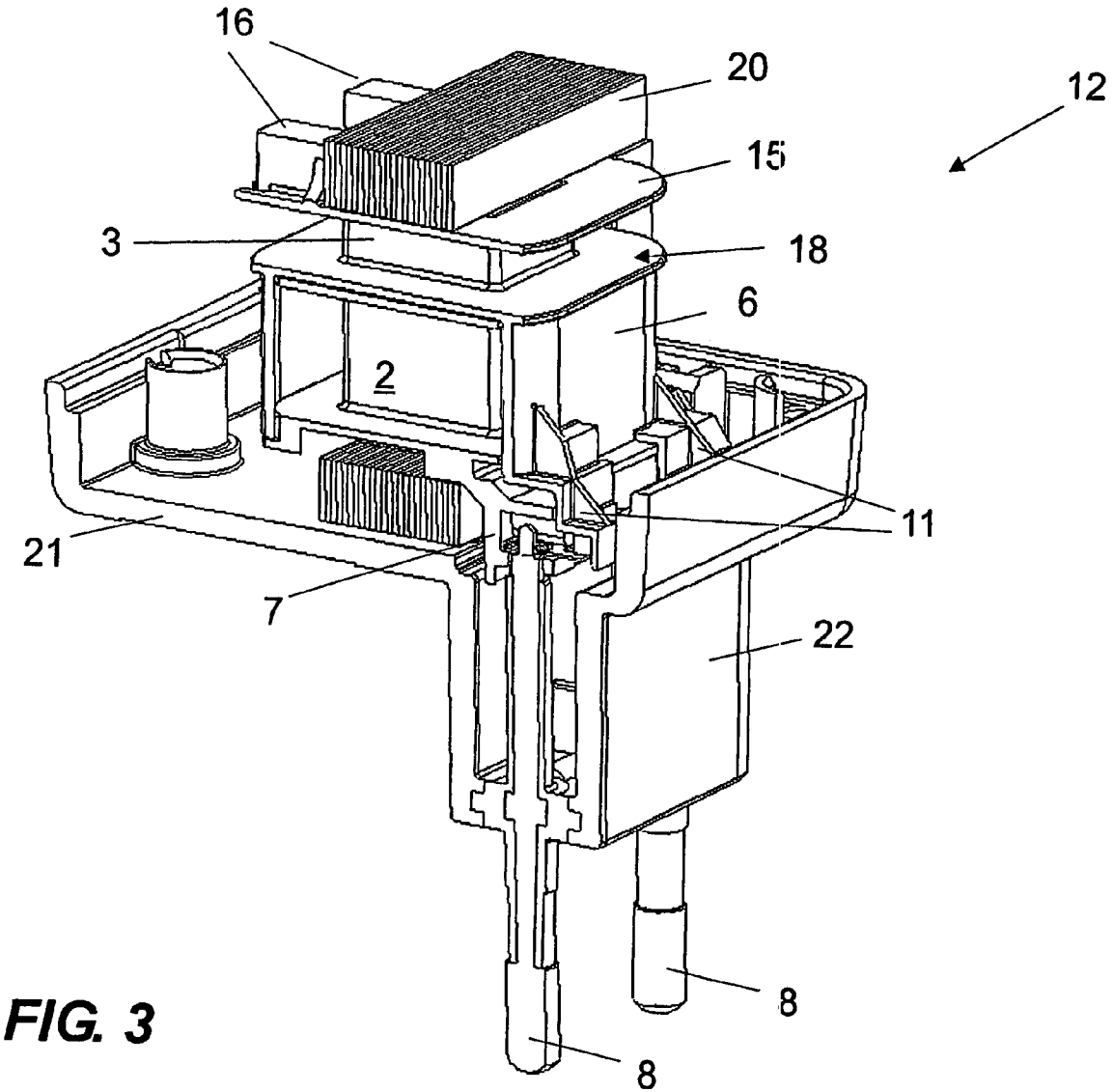
FIG. 3 shows a perspective sectional view of an assembled base-plate assembly with the transformer according to the first embodiment of the present invention.

FIG. 3 shows a perspective sectional view of an assembled base-plate assembly 12 with a transformer module 18 according to the first embodiment of the present invention.

The transformer module 18 shown in FIG. 2 has an iron core 20 inserted into it. Furthermore, the transformer module 18 is built into a housing 21 made of a conventional plastic material. Two contact pins 8 project from a contact region 22 which protrudes at an angle from the housing 21. The contact pins 8 traverse the contact region 22 of the housing 21 and make electrical contact with the primary part 4 of the transformer module 18. The contact pins 8 are AC contact pins, which are meant to connect the transformer module 18 to a socket (not shown) when in use so as supply the transformer module 18 with AC voltage. Due to the use of the insulation parts 11 in the connection regions 7 to the contact pins 8 and also due to the use of the covering 6 in the transformer module 18, the base-plate assembly shown in FIG. 3 is fire-protected.

The contact pins 8 in FIG. 3 are elongate and of circular cross-section and thus conform to a contact pin standard which is typically used in Europe apart from Great Britain. The present invention is not, however, restricted to such contact pins 8. Instead of these, other forms of contact pins or more than two contact pins can be used in the present invention.

Figure 4:
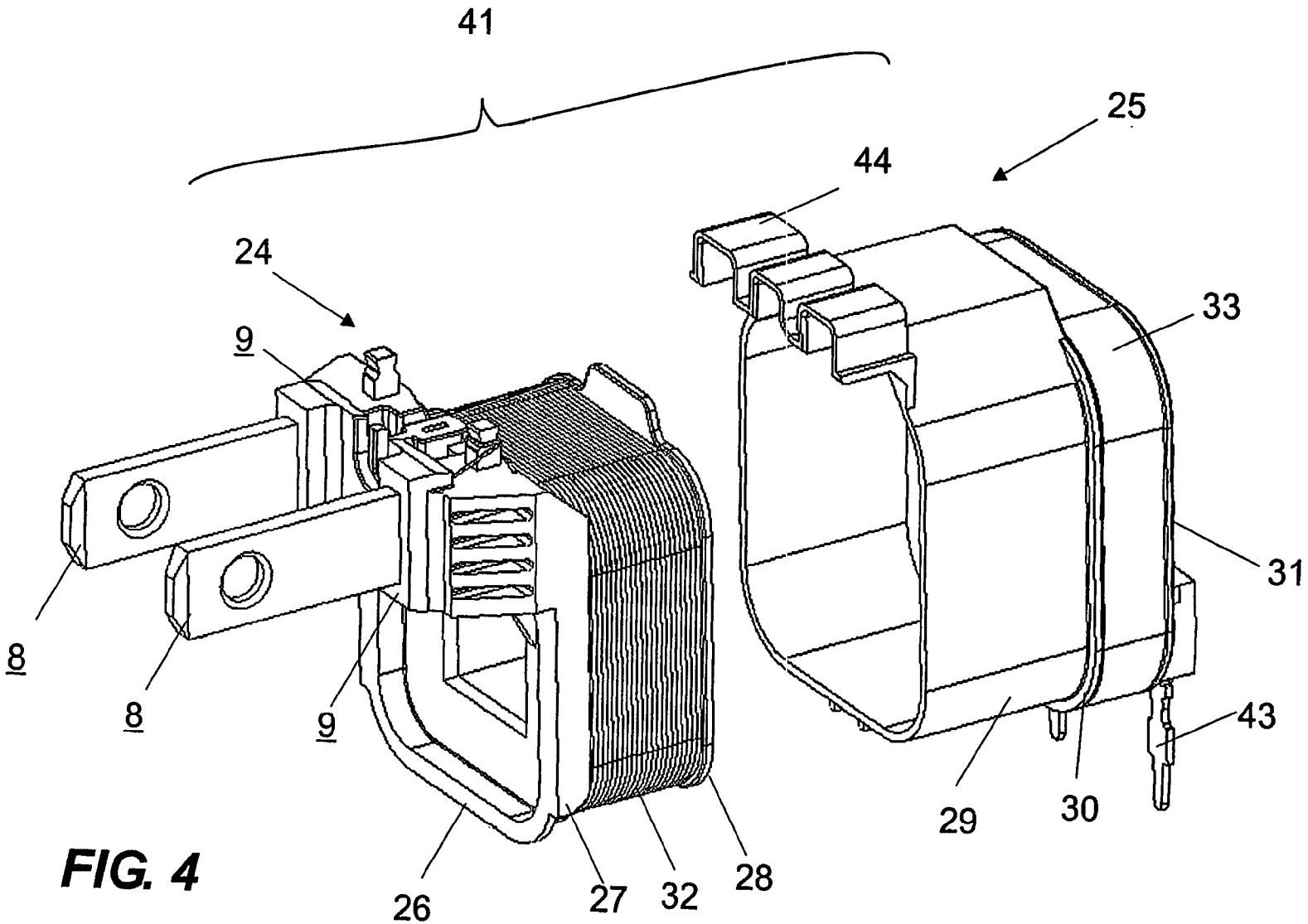
FIG. 4 shows a perspective view of a primary part and of a secondary part of a transformer according to a second embodiment of the present invention.

FIG. 4 shows a perspective view of a primary part 24 and of a secondary part 25 according to a second embodiment of the present invention.

The primary part 24 is shown separated from the secondary part 25 in the unassembled transformer. The primary part 24 and the secondary part 25 together form a coil body 41.

Much like the primary part 4 of the first embodiment of the invention, the primary part 24 of the second embodiment of the invention consists of a connection section 26, a spool 27 and a spool boundary 28. The connection section 26 has two connection regions 9, via which a connection to the contact pins 8 is established. The contact pins 8 are shielded in the connection regions 9 to the primary part 24, e.g. by encasing by means of injection moulding. A plastic, preferably of the fire-protection class UL94-V1, is used as injection-moulding material. Due to encasing by means of injection moulding the contact pins 8 are fixed in position relative to the primary part 24 and are electrically isolated externally. Instead of encasing by injection moulding, the connection regions 9 can, however, also be encased by casting or by some other method.

The contact pins 8 in FIG. 4 are plate-shaped perforated contact pins with beveled edges in a front region. They thus conform to a contact pin standard in use e.g. in the USA, China and Japan. However, instead of these contact pins other forms of contact pins can be used, e.g. pins with a circular cross-section. Instead of two contact pins, only one contact pin or more than two contact pins can be provided.

The connection section 26 of the primary part 24 is followed by the spool 27 with a primary coil 32 wound thereon. The spool 27 is followed immediately by a spool boundary 28.

The secondary part 25 possesses a cover region 29 which is pushed onto the primary coil 32 of the primary part 24 during assembly of the coil body 41.

Much like the secondary part 5 of the first embodiment of the invention, the cover region 29 has insulation parts 44 for covering the connection regions 9 of the primary part 24. These are pushed onto the corresponding connection regions 9 of the primary part 24 during assembly of the coil body 41 so as to enclose these. The insulation parts 44 are, like the cover region 29, made of a plastic material, preferably a fire-protection material of the fire-protection class UL94-V1, and thus provide both electrical insulation and fire-protection for the connection regions 9 after assembly of the coil body 41.

The cover region 29 is followed by a spool 30 with a secondary coil 33 wound thereon. The spool 30 is bounded on the other side by a spool boundary 31. Contact regions for DC contact pins 43 are located on the spool boundary 31.

Figure 5:
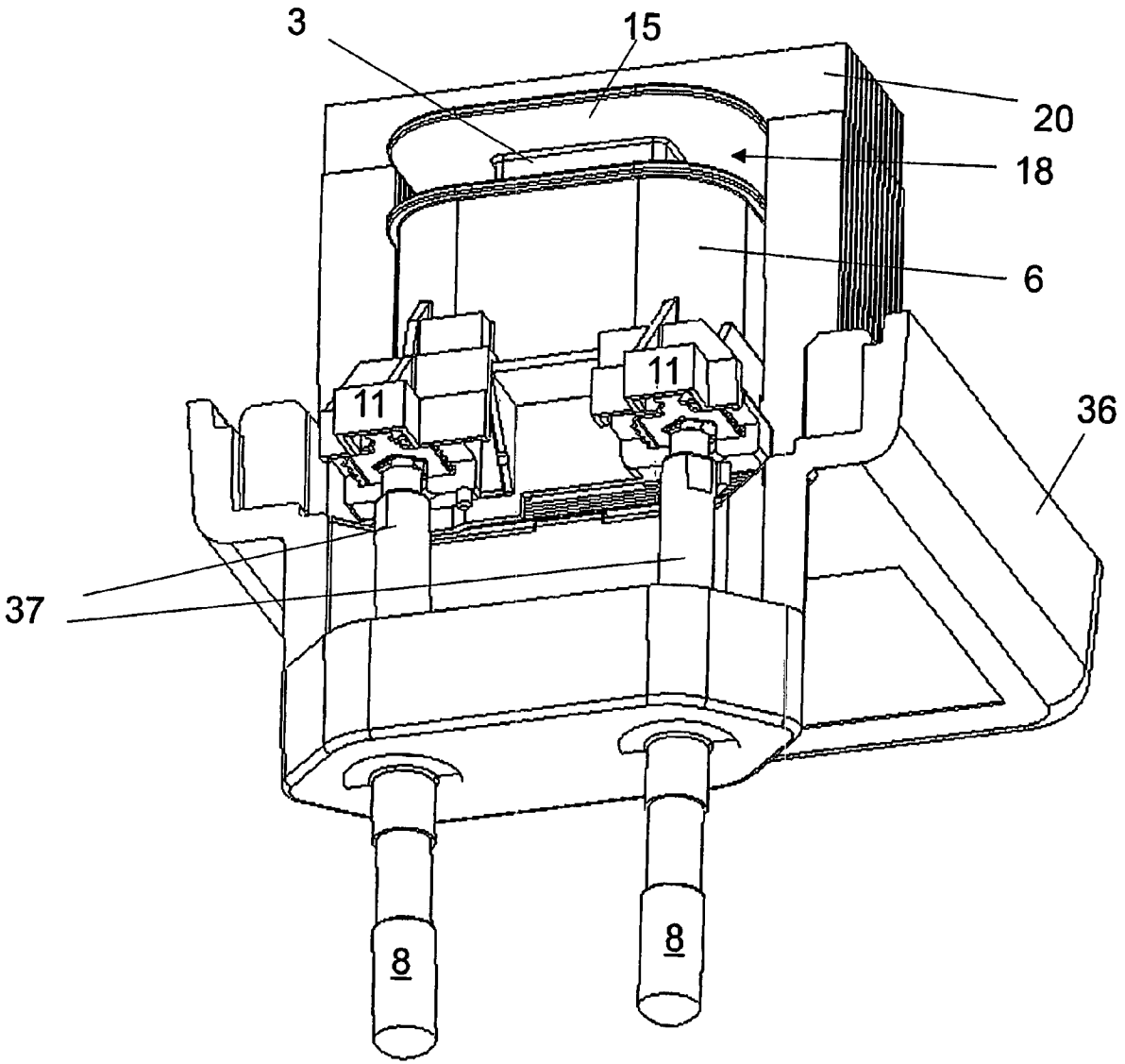
FIG. 5 shows a perspective sectional view of a transformer with a one-way plug connection according to a third embodiment of the present invention.

FIG. 5 shows a perspective view of a transformer according to a third embodiment of the present invention.

Here a transformer module is, like the transformer module 1 of the first embodiment of the invention, installed in a housing 36. Contact pins 8 which are electrically connected to the primary part 4 within the housing 36 project from the housing 36.

The contact pins 8 are provided with an electrical insulation 37 which encloses at least a peripheral region of the contact pins 8 within the housing 36. The insulation 37 is made of plastic, preferably a plastic of the fire-protection class UL94-V1 or better.

The contact pins 8 are connected to the primary part 4 of the coil body 1 within the housing 36 via a one-way plug connection 10. The one-way plug connection 10 is plugged in once and for all during assembly of the transformer and can subsequently only be disengaged with difficulty, if at all, even when it is subjected to a very strong tensile force, e.g. 50 N.

Figure 6:
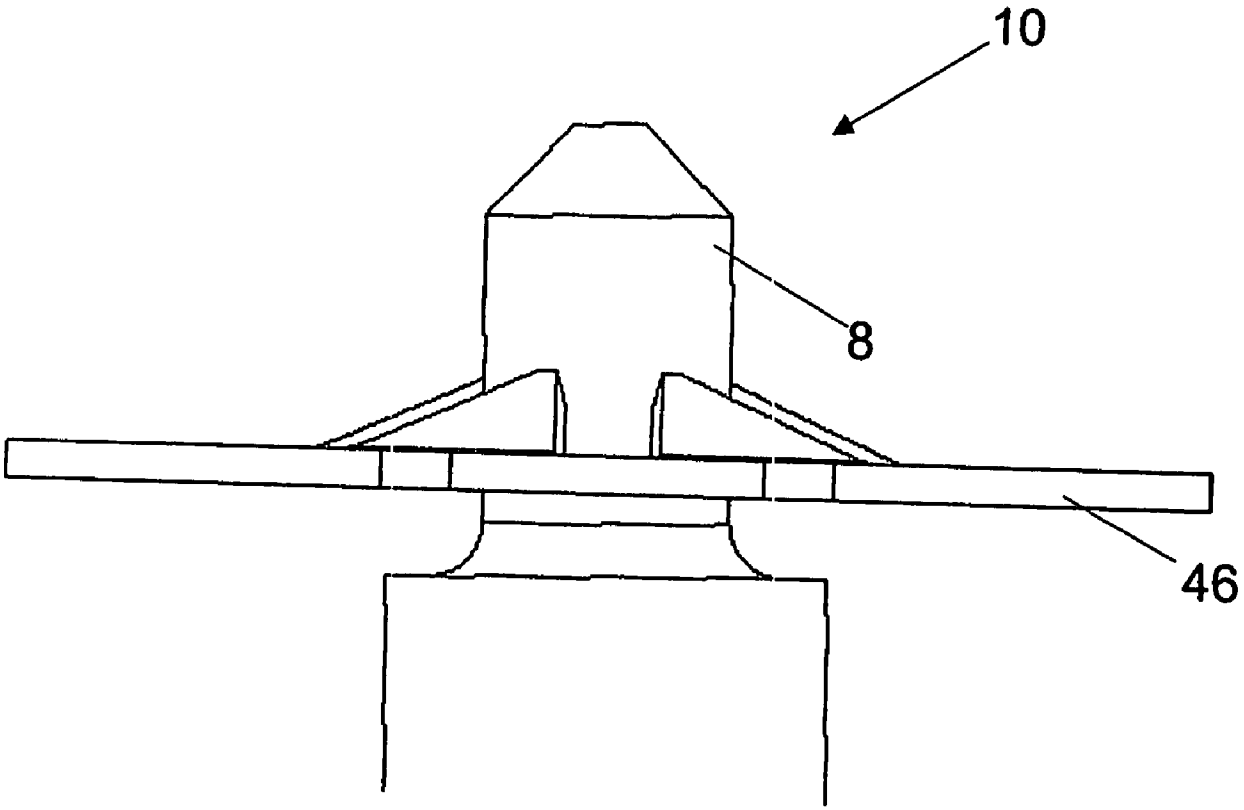
FIG. 6 shows a schematic sectional view of the one-way plug connection of the third embodiment of the present invention.

An example of the one-way plug connection 10 is shown in FIG. 6. The one-way plug connection 10 is so designed that the contact spring 46 is pushed onto the round contact pin 8. The contact spring 46 is expanded as a result of this action. Due to the restoring force of the contact spring 46 and the friction between the contact spring 46 and the contact pin 8, the connection can only be broken forcibly.

The one-way plug connection 10 is a safety plug connection, being such that the contact pins 8 remain fixed in position and isolated from contact by the user even if the outer equipment housing should be damaged, e.g. through being struck or improperly used. Even when the outer housing 36 has been damaged, the user can remove the remaining unit, consisting of the contact pins 8 and the coil body 1 of the transformer, from a mains socket without endangering himself since he cannot touch voltage-carrying and thus dangerous parts.

Although the third embodiment of the present invention in FIG. 5 shows contact pins 8 according to the European standard, this embodiment is also suited for use with contact pins or plug pins conforming to other standards.

Although the transformer of the present invention consists of two parts in the described embodiments, this is not necessary for the third embodiment of the invention. The transformer can also be implemented as a single-part coil body comprising a primary part accommodating the primary coil and a secondary part accommodating the secondary coil. The fire-protection function is provided by additional plastic parts or tapes in this case.

The invention claimed is:

1. A transformer, comprising:

at least one AC contact pin for contacting a mains voltage; and a coil body accommodating at least one primary coil and one secondary coil, wherein the coil body comprises at least one primary part accommodating the primary coil and one secondary part accommodating the secondary coil and wherein at least a region of the primary coil of the primary part is coverable by a least one section of the secondary part, wherein the secondary part includes a fire-protection material which is a plastic material of the fire-protection class UL94-V1 or better, wherein a connection region of the primary part is electrically connected to the at least one AC contact pin at an intersection, and wherein said intersection is covered by an associated insulation part which forms part of the secondary part.

2. The transformer according to claim 1, wherein the primary part and the secondary part are designed as two separable parts.

3. The transformer according to the claim 1, wherein said at least one section of the secondary part has an internal diameter which is greater than an external diameter of said at least one coverable section of the primary part.

4. The transformer according to claim 1, wherein the primary part is connected to the at least one contact pin via a one-way plug connection.

5. The transformer according to claim 4, wherein the one-way plug connection has at least one locking element which engages the primary part in a connection region from behind.

6. The transformer according to claim 1, wherein said at least one contact pin has an insulated sheath region.

7. The transformer according to claim 1, wherein the connection region comprises a connection tab, and wherein the associated insulation part covers substantially an entire length of the connection tab.

8. The transformer according to claim 1, further comprising a housing that at least partially encompasses the at least one AC contact pin and the coil body, wherein the housing comprises a material of a fire-protection class that is lower than the fire-protection class of the plastic material of the secondary part.

9. The transformer according to claim 1, wherein said associated insulation part at least partially covers the at least one AC contact pin.

10. The transformer according to claim 1, wherein the primary part comprises a primary spool for accommodating the primary coil and wherein the secondary part comprises a secondary spool for accommodating the secondary coil; wherein the secondary spool and secondary coil do not cover the primary spool and primary coil.

* * * * *

UNITED STATES PATENT AND TRADEMARK OFFICE

CERTIFICATE OF CORRECTION

PATENT NO. : 7,764,157 B2
APPLICATION NO. : 10/555153
DATED : July 27, 2010
INVENTOR(S) : Schulz et al.

It is certified that error appears in the above-identified patent and that said Letters Patent is hereby corrected as shown below:

Column 6, line 20, delete "a" and insert therefor --at--.

Signed and Sealed this

Fifth Day of October, 2010

David J. Kappos

David J. Kappos
*Director of the United States Patent and Trademark Office*